US005135552A

United States Patent [19]

Weistra

[11] Patent Number: 5,135,552

[45] Date of Patent: Aug. 4, 1992

[54] VACUUM CLEANER

[75] Inventor: Marten P. Weistra, Eindhoven, Netherlands

[73] Assignee: U.S. Philips Corp., New York, N.Y.

[21] Appl. No.: 802,954

[22] Filed: Dec. 5, 1991

[30] Foreign Application Priority Data

Dec. 5, 1990 [NL] Netherlands ..... 9002668

[51] Int. Cl.[5] ..... B01D 45/12; B01D 50/00

[52] U.S. Cl. ..... 55/337; 55/343; 55/345; 55/DIG. 3

[58] Field of Search ..... 55/337, 343, 349, 467, 55/DIG. 3, 345; 15/347, 352

[56] References Cited

U.S. PATENT DOCUMENTS

| | | | |
|---|---|---|---|
| 3,320,727 | 5/1967 | Farley et al. | 55/337 |
| 3,543,325 | 12/1967 | Hamrick | 55/337 X |
| 4,718,924 | 1/1988 | DeMarco | 55/337 X |
| 5,062,870 | 11/1991 | Dyson | 55/337 X |

FOREIGN PATENT DOCUMENTS 0121511 10/1984 European Pat. Off. .

*Primary Examiner*—Charles Hart

*Attorney, Agent, or Firm*—Ernestine C. Bartlett

[57] ABSTRACT

A vacuum cleaner is provided comprising a housing (1) with two filter systems (2,3) arranged in series, means (4) for generating an air flow through the filter systems, the second filter system (3) as seen in the direction of flow being a cyclone filter system, which vacuum cleaner is provided with one reservoir (5) for collecting dust from both filter systems (2,3), which reservoir can be closed off with a lid (14), is suitable for accommodating a disposable dust bag (6), and is furthermore divided into two compartments (5*a*, 5*b*) by a wall (13), each reservoir compartment serving to collect separated dust from the accompanying filter system, while the wall (13) is fastened in the reservoir (5) in such a way that it can be taken out. Preferably, the removable wall (13) is fastened to the lid (14).

As a result, the user can remove all the dust from the vacuum cleaner in one operation.

10 Claims, 2 Drawing Sheets

VACUUM CLEANER

FIELD OF THE INVENTION

The invention relates to a vacuum cleaner comprising a housing with two filter systems connected in series and means for generating an air flow through the filter systems, the second filter system as seen in the direction of flow being a cyclone filter system.

BACKGROUND OF THE INVENTION

Such a vacuum cleaner is known from EP-A-0121511.

It is known that dust can be effectively removed from an air flow by a cyclone filter system. A cyclone filter system, however, has the disadvantage that the material separated by the cyclone in the collector reservoir is subjected to small forces so that little densification takes place there in the case of fluffy material. As a result, the filling of the reservoir, also when the latter is full, consists mainly of air.

A normal paper dust bag of a comparable volume can contain a much greater mass of dust. This is because the material collected is continuously pressed home by the air sucked through it, so that the material is densified. A further advantage of a paper dust bag is that it can be easily and hygienically removed and disposed with. A disadvantage of a paper dust bag, however, is that fine dust quickly chokes up the bag, so that the flow resistance increases markedly and the air flow is strongly reduced. In addition, it is not ideal always to be dependent on a comparatively expensive paper dust bag which has to be re-purchased every time.

In EP-A-0121511 cited above the advantages of both filter systems are combined. For a cyclone this is the property that the flow resistance is independent of the quantity of dust already separated, and for the filter system the property that the separated dust is densified.

The vacuum cleaner described in EP-A-0121511 is a street vacuum cleaning machine. This machine comprises a separate collector reservoir for the dust from each of the filter systems. Both reservoirs are to be emptied from time to time. In view of the kind of refuse which is sucked up, the use of two reservoirs would seem to be necessary. If such a dual filter system should be used in a household vacuum cleaner, however, two collector reservoirs are inconvenient to use.

SUMMARY OF THE INVENTION

The invention has for its object the improvement of vacuum cleaner as described in the opening paragraph in such a manner that the user can remove all the dust from the vacuum cleaner in one operation.

The vacuum cleaner according to the invention is for this purpose characterized in that the vacuum cleaner is provided with one reservoir for collecting dust from both filter systems, which reservoir can be closed off by a lid, is suitable for accommodating a disposable dust bag, and is furthermore divided into two compartments by a wall, each reservoir compartment serving to collect dust separated by the accompanying filter system, while the said wall is fastened in the reservoir in such a way that it can be taken out.

An advantage of the vacuum cleaner according to the invention is that after the removal of the partition wall all the dust can be taken from the vacuum cleaner housing by means of the disposable dust bag in one operation and put in a refuse container. The vacuum cleaner is ready for use again after the provision of a new disposable dust bag and the return of the partition wall.

A preferred embodiment of the vacuum cleaner is characterized in that the removable wall is fastened to the lid. This means that the removable wall is automatically taken from the reservoir when the lid is taken off.

A further preferred embodiment of the vacuum cleaner is characterized in that the cyclone filter system is fastened to the lid. If it is necessary for the cyclone filter system to be removed in order to render the reservoir accessible, it is preferred to use an arrangement wherein the cyclone filter system is fastened to the lid. A further embodiment is characterized in that a window frame is present for clamping an upper edge of the disposable dust bag on an upper rim of the reservoir. This prevents the disposable dust bag detaching itself from the upper rim of the reservoir during closing of the lid or during operation of the vacuum cleaner.

A preferred embodiment of the vacuum cleaner is characterized in that the first filter system as seen in the direction of flow is formed by a plate provided with holes. The plate provided with holes is also to be removed before emptying of the reservoir. It was found that, when a plate provided with holes is used as a coarse filter, no dust such as hairs and the like adhere to this filter plate when it is removed. During operation of the vacuum cleaner, a turbulent air flow is generated in the reservoir portion in front of the first filter system, so that the coarse dust taken in is continuously rotated. The hairs and fluffs present especially in the coarse dust do not enter the openings of the filter plate, but are as it were wound into a ball. Only the fine dust continues to the cyclone filter. After some time the entire filter plate is covered and the intake material more or less settles.

The filter plate provided with holes is preferably fastened to the lid, as is the partition wall. Thus the partition wall as well as the filter plate is automatically removed from the reservoir when the lid is taken off, so that the disposable dust bag can be taken out.

A cyclone filter system could also be used as the first filter system, in such a way that both cyclone filter systems are arranged next to one another.

BRIEF DESCRIPTION OF THE DRAWING

The invention will now be explained in more detail with reference to an embodiment shown in a drawing, in which.

DETAILED DESCRIPTIONS OF THE PREFERRED EMBODIMENTS

Figure 1:
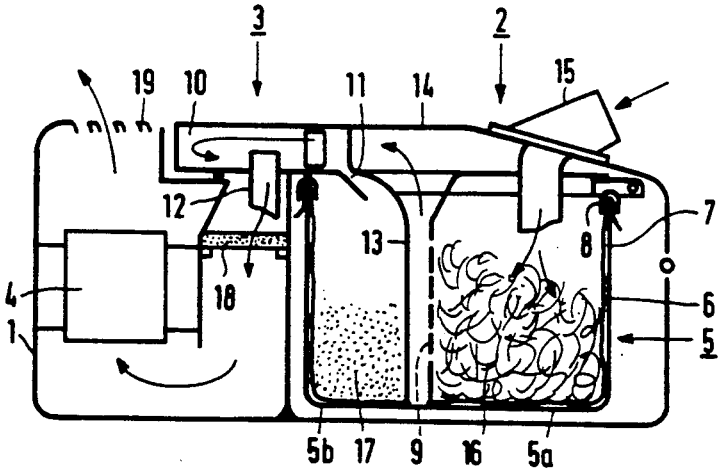
FIG. 1 diagrammatically depicts a vacuum cleaner with a dual filter system according to the invention, FIG. 2 diagrammatically shows the vacuum cleaner of FIG. 1 with the lid raised.

The vacuum cleaner is built up from a housing 1 with two filter systems 2, 3 arranged in series and a motor unit 4 for generating an air flow through the filter systems. The vacuum cleaner is provided with one reservoir 5 for collecting dust from both filter systems. The reservoir is suitable for accommodating a disposable dust bag 6. To this end, the edge of the bag is folded around the upper rim 7 of the reservoir and clamped on this upper rim by means of a window frame 8. The disposable dust bag may even be a simple, preferably environment-friendly plastic bag.

The first filter system 2 as seen in the direction of flow is formed by a filter plate 9 provided with holes. The second filter system 3 as seen in the direction of flow is a cyclone filter system with a flat box-shaped cyclone chamber 10, a discharge slot 11 for admitting dust to the reservoir 5, and a central outlet opening 12 for the air. The reservoir 5 is provided with a wall 13 which divides the reservoir into two compartments 5*a*, 5*b*, each for collecting separated dust from the accompanying filter system 2, 3, respectively. The reservoir 5 can be closed off with a lid 14 which is hinged to the housing 1 of the vacuum cleaner. The filter plate 9, the partition wall 13, and the cyclone chamber 10 are fastened to the inside of the lid 14.

Figure 2:
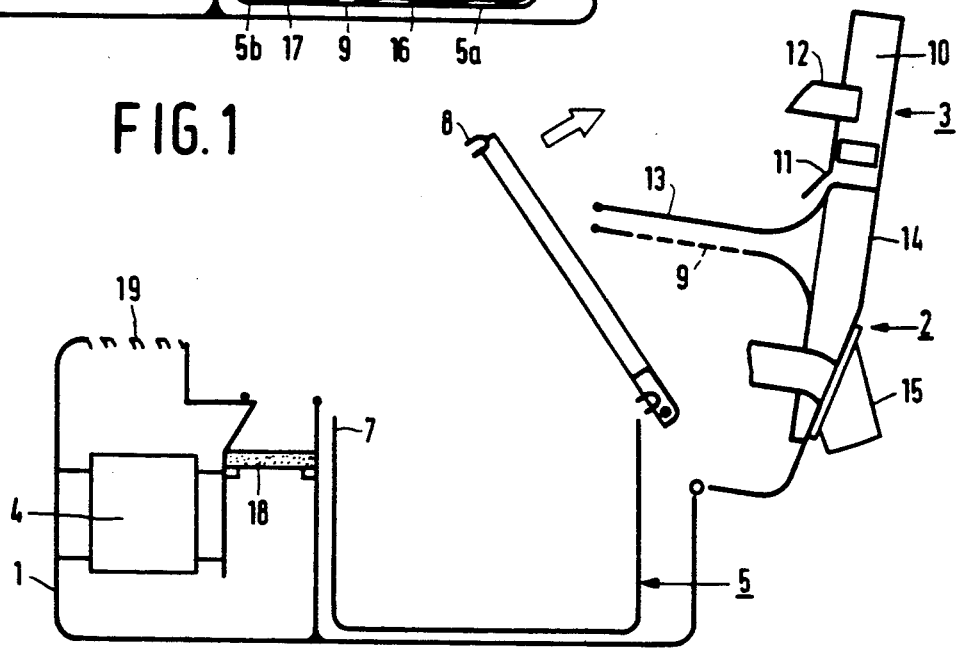
Figure 3:
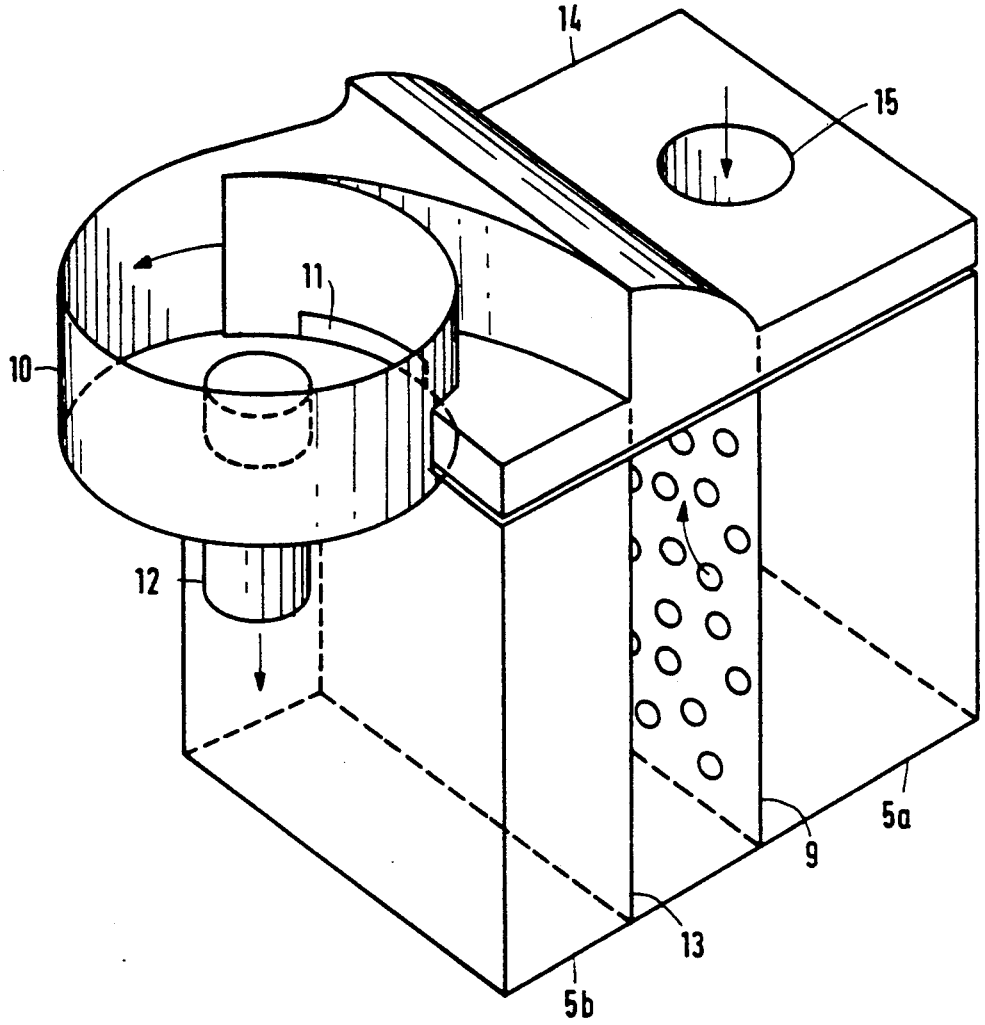
FIG. 3 is a perspective view of a model of the dual filter system of FIG. 1.

The operation of the vacuum cleaner is as follows: air which contains dust is sucked into the reservoir compartment 5*a* through an inlet opening 15 of the lid 14, passes the filter plate 9 provided with holes, whereby large dust particles 16, such as hairs, fluffs and the like, are stopped by the filter plate 9, upon which the air containing only small dust particles 17 is sucked into the cyclone chamber 10 and the small dust particles end up in the reservoir compartment 5*b* through the discharge slot 11. This is clarified in FIG. 3 by means of a perspective view of a test model. The vacuum cleaner housing containing the motor and other parts have been left out here. The substantially clean air then passes a motor filter 18 for protecting the motor unit 4 and leaves the vacuum cleaner through a grille 19. The large dust particles 16 are united into ball-shaped package lying against the filter plate by the initially turbulent air flow in the reservoir compartment 5*a*, the small dust particles 17 accumulate upwards starting from the bottom of the reservoir compartment 5*b*. When the reservoir compartment 5*a* is full, which may be displayed by means of a pressure indicator, the disposable dust bag must be replaced. To this end, the lid 14 of the vacuum cleaner is hinged upwards, by which both the filter plate 9 and the partition wall 13 are also moved away (FIG. 2). After removal of the window frame 8, the full bag 6 may be taken from the reservoir 5 and thrown into a waste bin, upon which a new bag can be put in the reservoir again.

Figure 4:
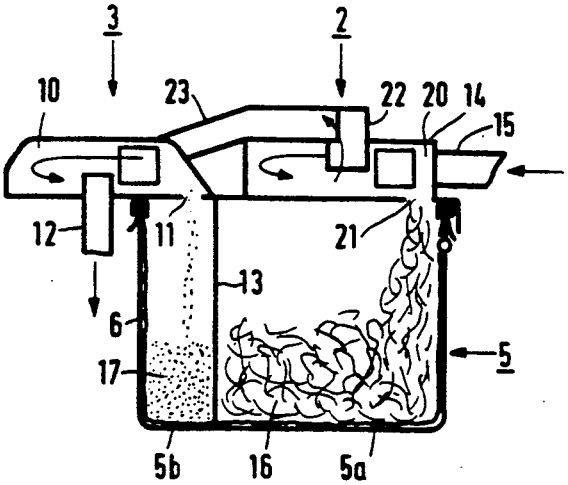
FIG. 4 is another diagrammatic model of a dual filter system comprising two cyclones.
Figure 5:
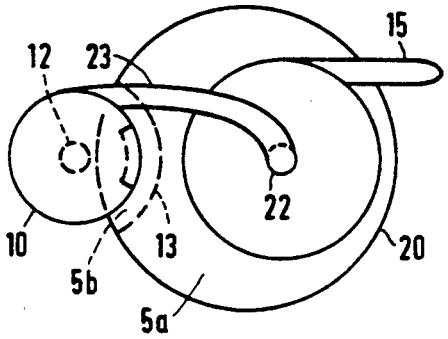
FIG. 5 is a plan view of the model shown in FIG. 4.

The vacuum cleaner may also be built up from two cyclone filter systems connected in series. The two systems are situated next to one another in FIGS. 4 and 5. Air containing dust is sucked into the cyclone chamber 20 of the first cyclone filter system 2 through an inlet opening 15. The large dust particles 16 are separated in the cyclone chamber 20 and enter the reservoir compartment 5*a* through the discharge slot 21. The air containing the smaller dust particles 17 leaves the first cyclone through an outlet opening 22 and reaches the cyclone chamber 10 of the second cyclone filter system 3 through a connection channel 23. In this latter system, the smaller dust particles 17 are separated and enter the reservoir compartment 5*b* through opening 11. The clean air leaves the second cyclone through the outlet opening 12. Both cyclone filter systems 2 and 3 are fastened to the lid 14 of the reservoir 5. When the reservoir is to be emptied, the lid 14 is removed (for example, swivelled up), owing to which the partition wall 13 leaves the reservoir 5. The disposable dust bag 6 can now be readily removed.

I claim:

1. A vacuum cleaner comprising a housing (1) with two filter systems (2, 3) connected in series and means for generating an air flow through the filter systems, the second filter system (3) as seen in the direction of flow being a cyclone filter system, wherein the vacuum cleaner is provided with one reservoir (5) for collecting dust from both filter systems (2, 3), which reservoir can be closed off by a lid (14), is suitable for accommodating a disposable dust bag (6), and is furthermore divided into two compartments (5*a*, 5*b*) by a wall (13), each reservoir compartment serving to collect dust separated by the accompanying filter system, while the said wall (13) is fastened in the reservoir (5) in such a way that it can be removed.

2. A vacuum cleaner as claimed in claim 1 wherein the removable wall (13) is fastened to the lid (14).

3. A vacuum cleaner as claimed in claim 2 wherein the cyclone filter system (3) is fastened to the lid (14).

4. A vacuum cleaner as claimed in claim 3 wherein the lid (14) is hinged to the housing (1) of the vacuum cleaner.

5. A vacuum cleaner as claimed in claim 1 wherein a window frame (8) is present for clamping an edge of the disposable dust bag (6) on an upper rim (7) of the reservoir (5).

6. A vacuum cleaner as claimed in claim 1 wherein the first filter system (2) as seen in the direction of flow is formed by a plate (9) provided with holes.

7. A vacuum cleaner as claimed in claim 6 wherein the holes said are not more than 2 mm large.

8. A vacuum cleaner as claimed in claim 6 wherein the lid (14) is provided with an inlet opening (15) for the first filter system (2).

9. A vacuum cleaner as claimed in claim 1, wherein the first filter system (2) as seen in the direction of flow is also a cyclone filter system and in that both cyclone filter systems (2, 3) are arranged next to one another.

10. A vacuum cleaner as claimed in claim 9 wherein both cyclone filter systems (2, 3) are fastened to the lid (14) and are each provided with a flat, box-shaped cyclone chamber (20, 10) whose bottom comprises a discharge slot (21, 11) which provides access to the accompanying reservoir (5*a*, 5*b*).

* * * * *